US005238213A

United States Patent [19]

Pool

[11] Patent Number: 5,238,213

[45] Date of Patent: Aug. 24, 1993

[54] EXTENDABLE SUPPORT

[75] Inventor: James L. Pool, Clarinda, Iowa

[73] Assignee: Lisle Corporation, Clarinda, Iowa

[21] Appl. No.: 861,523

[22] Filed: Apr. 1, 1992

[51] Int. Cl.[5] ..... E04G 25/00

[52] U.S. Cl. ..... 248/352; 248/354.1; 292/305; 292/338

[58] Field of Search ..... 248/352, 354.1, 200.1; 292/338, 306; 180/69.21

[56] References Cited

U.S. PATENT DOCUMENTS

| | | | |
|---|---|---|---|
| 2,051,969 | 8/1936 | Shastock | 292/306 X |
| 2,671,355 | 3/1954 | hawkins | 292/306 X |
| 3,480,247 | 11/1969 | Waner | 292/306 X |
| 3,615,114 | 10/1971 | harris | 292/306 X |
| 3,711,892 | 1/1973 | Tabor | 248/354.1 X |

OTHER PUBLICATIONS

Mac Tool "Hood Holder", Model HH387, shown in catalogue, Miscellaneous Body Tools, p. 345.

*Primary Examiner*—Ramon O. Ramirez
*Attorney, Agent, or Firm*—Allegretti & Witcoff, Ltd.

[57] ABSTRACT

A hood prop or support tubes two or more telescoping tubular members which are locked together by means of a plate retained within the larger diameter tubular member that is biased by one of the bearing supports for the inner tubular member, and which may be manually released by pushing the plate by the biasing force of the spring.

8 Claims, 2 Drawing Sheets

EXTENDABLE SUPPORT

BACKGROUND OF THE INVENTION

This invention relates to a prop or support, which is adapted to support an automobile hood, trunk lid, door or the like. More particularly, this invention relates to an adjustable, extendable support or prop.

When repairing an automobile engine, for example, it is necessary to support or prop the hood or bonnet of the vehicle in an open position. Typically, the hood will be retained in the open position by the hood hinge mechanism. However, it is necessary to provide an auxiliary support since the support mechanism which is associated with the vehicle may not have sufficient mechanical strength to safely maintain the hood in a raised position. Using an auxiliary support or prop for holding a hood in an open position will also prevent the hood from inadvertently falling upon a mechanic or repair man, who happens to be working on the automobile engine.

Heretofore placement of a rod to provide auxiliary support of a hood has been accomplished merely by cutting an appropriate length of stock material and using that stock as a prop to support the hood. Such a support will not work in all circumstances, however, because of the need to accommodate various sizes of hoods, doors and lids. For this reason a hood support which has an adjustable length has been preferred. Such hood holders or supports have been commercially available. They are generally comprised of telescoping members which include a locking mechanism to permit adjustment of the relative or effective length of the telescoping members. Such a device is depicted generally in prior art FIG. 1 of the drawing. A commercial embodiment of such a product has been made by Mac Tools and is sold as their product No. HH387 Hood Holder. Other extendable devices of this nature have, on information and belief, been available commercially.

Nonetheless, there has remained the need for an improved, extendable support or prop, which has a wide range of extension, which is economical to manufacture, which has a simplified and compact construction and which has an aesthetic and mechanical appearance that eliminates a projecting edge to the maximum extent possible. These objective and goals, among others, inspired the present invention.

SUMMARY OF THE INVENTION

Briefly, the present invention comprises at least first and second hollow tubular members, one of which is telescopically slidable within the other. The outer tubular member has one end configured as a bearing for slidably receiving the inner tubular member. An opening through the outer member receives a pivot plate. A through passage in the pivot plate permits the inner member to slidably pass therethrough and telescope within the outer member. A biasing spring is positioned between the bearing surface and the plate within the outer tubular member and thereby pivots and biases the plate into engagement against the inner tubular member. The through passage of the plate defines an acute angle edge. In this manner a sharp edge is defined on the plate for engagement with the outside surface of the inner tubular member. The biasing force against the plate then causes that sharp edge to tightly engage the inner member and prevent it from sliding or telescoping except when the plate is manually moved against the biasing force to thereby release the sharp edge from engagement.

A multiple series of such telescoping tubular members, each having its own plate which acts as a locking mechanism, may be provided to define an extendable support. Thus, it is an object of the invention to provide an improved telescoping support for support or a hood, a lid or the like.

It is a further object of the invention to provide an improved prop comprised of telescoping members wherein the members provide bearing and guide surfaces for the telescoping members one within the other.

Yet another object of the invention is to provide an improved telescoping prop or support construction wherein a locking plate is incorporated near the juncture between the telescoping tubular members and further wherein the locking plate is retained internally within the tubular members to effectively increase the usable or workable length of the prop or support.

Yet another object of the invention is to provide an improved prop or support which is easily manufactured and which provides a unique combination of elements utilized to effect locking and unlocking of the telescoping members defining the prop or support.

These and other objects, advantages, and features of the invention will be set forth in the detailed description that follows.

BRIEF DESCRIPTION OF THE DRAWING

In the detailed description which follows, reference will be made to the drawing comprised of the following FIGURES.

DESCRIPTION OF THE PREFERRED EMBODIMENT

Figure 1:
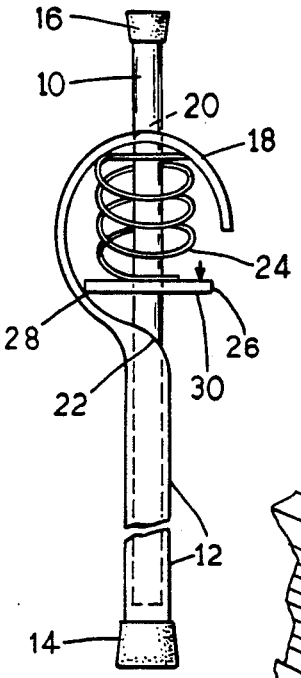
FIG. 1 PRIOR ART
FIG. 1 is a front elevation of a typical prior art extendable support or prop.

FIG. 1 depicts a typical prior art prop or support. The device includes a tube or rod 10 which is telescopically received by hollow tube 12. The hollow tube 12 includes a tip such a rubberized tip 14. In a similar fashion the narrow diameter rod 10 includes a rubberized tip 16. The larger diameter hollow tube 12 has its remaining end flattened and formed as a partial loop crook to define a supporting end 18. The crook or end 18 includes a through passage 20 axially aligned with the tube 12. A through passage 22 is axially drilled through the tube 12 so that the rod 10 may fit through the passages 20 and 22 and the slidable rod 10 may be received within the tube 12. A spring 24 is positioned against a plate 26 which has an opening 27 to receive the rod 10. One end of the plate 26, namely end 28, pivotally engages against the side of the crook 18. The opposite end 30 of the plate 26 is accessible for manual actuation. Spring 28 biases the plate into engagement with the rod 10 to thereby lock the rod 10 into a non-extendable position. Manually pushing on the plate 26 against the biasing force of the spring 24 will permit movement of the rod 10 and thus alteration of the effective length of the support shown in FIG. 1.

The prior art construction of FIG. 1 is an effective support or prop. However, various perceived deficiencies appear including the following: the mechanism for locking rod 10 is totally accessible and in the open. Thus, there are many pinch points and the possibility that items such as wires or cloth could be caught in the spring 18 or on the plate 26 or the like; with the construction of the crook 18 it is necessary to appropriately align openings 20 and 22 which may during manufacturing be difficult; the depicted arrangement requires a portion of tube 12 to be element formed as the crook 18, thus decreasing the potential effective range of adjustment of the support or prop and requiring extra material.

Figure 2:
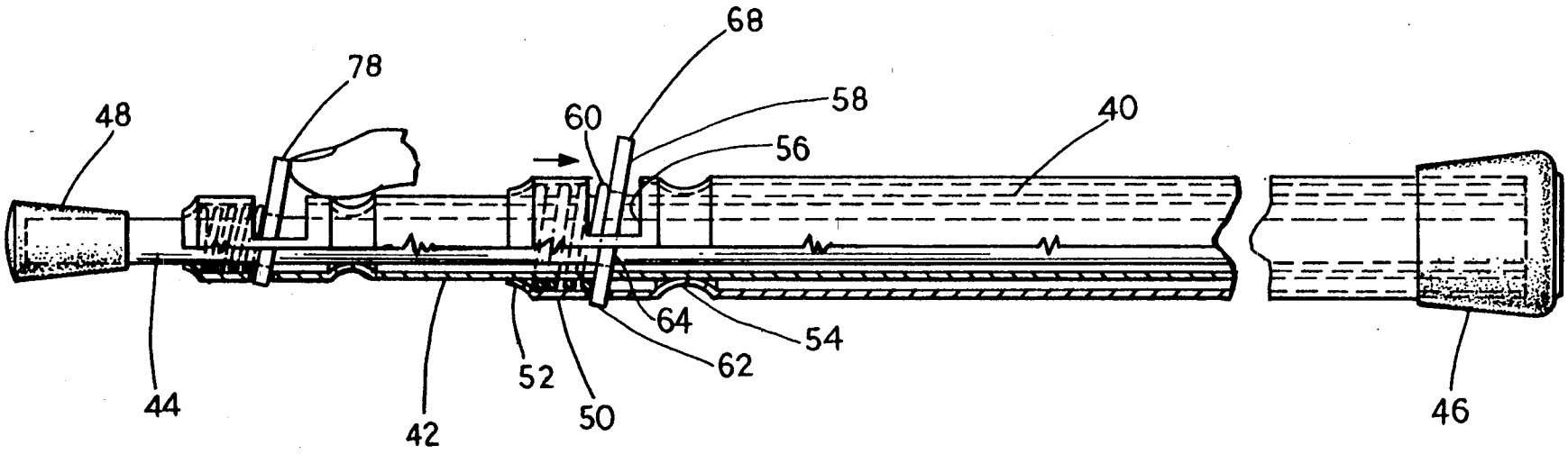
FIG. 2 is a side elevation of the improved support of the present invention.

FIG. 2 illustrates the improved support or prop of the present invention. The prop of the present invention is comprised of a series, in the embodiment depicted, of three hollow, cylindrical, tubular members 40, 42 and 44 having successively decreasing diameters so that they are telescopically receivable, one within the other. The largest diameter telescoping member 40 includes a large rubberized tip 46 attached at its one free end. The smallest diameter tube or leg 44 includes a small rubberized tip 48 at its free end.

Referring to the large diameter tube 40, the first or operative end 50 of the tube 40 includes a first formed bearing 52, which is defined as a narrow or neck portion of the tube 40. Spaced therefrom is a second bearing 54, again formed by necking the tube 40. Note that the inner diameter of the bearings 52 and 54 is substantially the same diameter as the outside diameter of the intermediate tube 42 so that the intermediate tube 42 can be slidably guided and received by the bearings 52 and 54. The bearings 52 and 54 are spaced one from the other and a semi-cylindrical slot or opening 56 is defined therebetween in the tube 40. Positioned within the slot 56 is a locking plate 58 which is depicted in greater detailed in FIGS. 3 and 4. A spiral biasing spring 60 is interposed between the inside of the bearing 52 and against one side of the plate 58. The biasing spring 60 encircles the tube 42 and thus provides a biasing force against the plate 58 in the direction of the arrow in FIG. 2.

Figure 3:
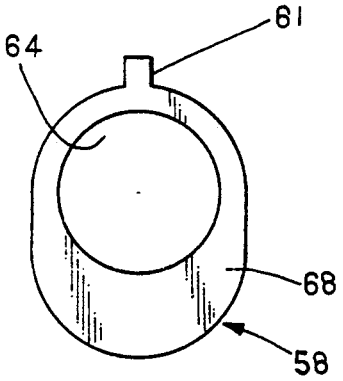
FIG. 3 is a plan view of the manual lock or latch plate associated with the present invention.
Figure 4:
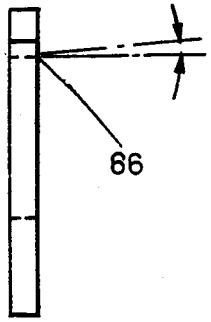
FIG. 4 is a side elevation of the lock or latch plate of FIG. 3.

The plate 58 includes a tab or pivot extension 61 which fits through an opening 62 drilled in the large diameter tube 40, so that the plate 58 can pivot about the pivot point defined by the opening 62. As depicted in FIGS. 3 and 4 the plate 58 includes a through passage or a through bore 64, which receives the telescopic tube 42 therethrough. The through passage 64 is not drilled at a normal (perpendicular) angle through the plate. Rather, the through passage is drilled at a slight angle off normal of approximately five degrees as depicted in FIG. 4 to thereby define an acute angle sharp edge 66 which can impinge against the outer surface of the tube 42. The sharp edge 66 thus can be locked against the outer surface of tube 42 by means of the biasing spring 60, which provides a biasing force against the plate 58.

Note that the plate 58 includes a manually actuable tab 68, which as depicted in FIG. 2, may be manually pushed against the force of the biasing spring 60, to thereby release the sharp edge 66 from engagement with the outside surface of the tube 42. Thus, the tab 68 projects beyond the opening 56 for manual actuation.

In the embodiment shown, the prop or support includes a first lock or latch 58 associated with the telescoping tubular members 40 and 42. Also included is a second tab or latch 78 associated with and having substantially identical construction. The second tab 78 is associated with the tube 42 and 44. It is thus possible to provide one, two or multiple numbers of telescopic tubes to provide an extendable prop or support.

Among the important features of the invention is the construction of the bearing surfaces 52 and 54 which are separated one from the other and which, in the region of separation, provide for receipt of the latch 58 and the spring 60. Note also that the bearing surface 52 provides for bearing support not only of the telescoping member 42, but also a support for the spring 60.

The particular construction described is quite compact and provides for enhanced efficiency of construction and removal of pinch points with respect to the telescoping extension mechanism. By special construction of the through passage 64 it is possible to provide enhanced control and rigidity of the telescoping members 40 and 42.

Figure 5:
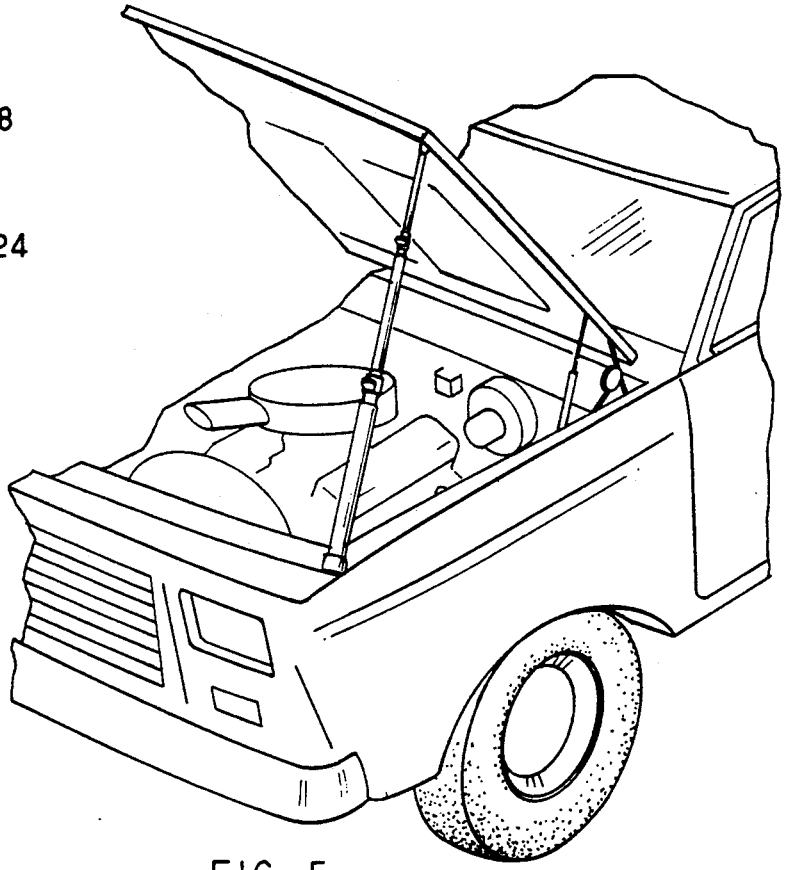
FIG. 5 is a perspective view of an automobile hood as supported by a support or prop of the present invention.

FIG. 5 illustrates the manner in which the extendable prop may be utilized to support a hood. Note that with the particular construction described it is possible to adjust the extension of the support in an easy manner. It is also possible to provide for a wide range of adjustment because of the capability of providing numerous sections of extendable tubular members. Thus, the support may have a rather short and compact construction, yet provide a wide range of extension.

Various changes may be made without affecting the scope of the invention. For example, additional bearing surfaces may be added along the length of the tubes. The tubes may be molded plastic, extruded plastic, or formed metal. The particular cross section configuration of the tubes may be varied. The particular construction of the spring 60 may be varied. Particular construction of the latch or lock 58 as well as the through bore 64 may be varied. Thus, the invention is to be limited only by the following claims and equivalents thereof.

What is claimed is:

1. An extendable prop for supporting an automobile hood, a door, or a lid comprising, in combination:

first and second hollow tubular members, the first member being slidably telescoped within the second member at one end of the second member, the second member having at least a first bearing support for slidably supporting the first member, said bearing support being adjacent the one end of the second member, the second member including an opening through a side wall thereof with the bearing support between the opening and the one end of the second member, the second member also having a second bearing support within the second member for slidably supporting the first member, the second bearing support being spaced from the first bearing support and on the opposite side of the opening from the first bearing support;

a locking lever comprising a generally planar plate with a through passage for receipt of the first tubular member, said through passage oversized relative to the cross-sectional profile of the first member, said locking lever further including a pivot connection to the second tubular member positioned generally opposite the second member opening, said planar plate including a manually actuatable tab extending through the opening for manual pivotal member of the plate about the pivot connection; and means for biasing the locking lever plate about the pivot connection, said means for biasing intermediate the first bearing support and the locking lever plate to thereby bias an edge of the through passage of the plate against the outside surface of the first member to preclude telescoping movement of the first member in the second member, whereby the locking lever plate is manually pivotal against the force of the means for biasing to release from engagement with the first tubular member and thereby permit manual telescoping of the first tubular member, said locking lever plate upon being released from manual movement moving in response to the means for biasing and engaging with the first tubular member to maintain the length of the extendable prop.

2. The prop of claim 1 including a third hollow tubular member slidably telescoped in the first member, and further including means for locking the third member in a fixed position within the first member.

3. The prop of claim 1 wherein the first member and second member are hollow cylinders.

4. The prop of claim 1 wherein the through passage in the plate defines an acute angle edge for engaging the first member.

5. The prop of claim 1 wherein the means for biasing comprises a spiral spring fitted about the first member between the first bearing support and the locking lever plate.

6. The prop of claim 1 wherein the pivot connection comprises a tab extension of the plate and a cooperative tab receiving passage in the second member.

7. The prop of claim 3 wherein the bearing support comprises a reduced diameter length of the first cylindrical tubular member.

8. An extendable prop for supporting an automobile hood, a door, or a lid comprising, in combination:

first, second and third hollow, cylindrical tubular members, the first member being slidably telescoped within the second member at one end of the second member, the third member being slidably telescoped in the first member, the second member having at least a first bearing support for slidably supporting the first member, said bearing support being adjacent the one end of the second member and having a reduced diameter length of the first cylindrical tubular member, the second member including an opening through a side wall thereof with the bearing support between the opening and the one end of the second member, the second member also having a second bearing support within the second member for slidably supporting the first member, the second bearing support being spaced from the first bearing support and on the opposite side of the opening from the first bearing support;

means for locking the third member in a fixed position within the first member;

a locking lever comprising a generally planar plate with a through passage for receipt of the first tubular member, said through passage oversized relative to the cross-sectional profile of the first member and defining an acute angle edge for engaging the first member;

said locking lever further including a pivot connection to the second tubular member positioned generally opposite the second member opening, the pivot connection having a tab extension of the plate and a cooperative tab receiving passage in the second member, said planar plate including a manually actuatable tab extending through the opening for manual pivotal member of the plate about the pivot connection; and a spiral spring fitted about the first member between the first bearing support and the locking lever plate, thereby biasing the locking lever plate about the pivot connection and biasing an edge of the through passage of the plate against the outside surface of the first member to preclude telescoping movement of the first member in the second member, whereby the locking lever plate is manually pivotal against the force of the means for biasing to release from engagement with the first tubular member and thereby permit manual telescoping of the first tubular member, said locking lever plate upon being released from manual movement moving in response to the means for biasing and engaging with the first tubular member to maintain the length of the extendable prop.

* * * * *